US010012955B2

(12) United States Patent
Born et al.

(10) Patent No.: US 10,012,955 B2
(45) Date of Patent: Jul. 3, 2018

(54) BIMATERIAL ANTI-SHOCK SYSTEM FOR TIMEPIECES

(71) Applicant: The Swatch Group Research and Development Ltd, Marin (CH)

(72) Inventors: Jean-Jacques Born, Morges (CH); Jean-Claude Martin, Montmollin (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/102,104

(22) PCT Filed: Dec. 5, 2014

(86) PCT No.: PCT/EP2014/076783
§ 371 (c)(1),
(2) Date: Jun. 6, 2016

(87) PCT Pub. No.: WO2015/086472
PCT Pub. Date: Jun. 18, 2015

(65) Prior Publication Data

US 2016/0306326 A1 Oct. 20, 2016

(30) Foreign Application Priority Data

Dec. 11, 2013 (EP) ..... 13196736

(51) Int. Cl.
*G04B 31/02* (2006.01)
*G04B 31/00* (2006.01)
(Continued)

(52) U.S. Cl.
CPC ..... *G04B 31/02* (2013.01); *G04B 31/016* (2013.01); *G04B 31/06* (2013.01)

(58) Field of Classification Search
CPC .... G04B 31/00; G04B 31/004; G04B 31/012; G04B 31/016; G04B 31/02
See application file for complete search history.

(56) References Cited

U.S. PATENT DOCUMENTS 3,306,027 A * 2/1967 Schneider ..... G04B 31/016 368/326
3,712,051 A * 1/1973 Romang ..... G04B 31/04 368/326
(Continued)

FOREIGN PATENT DOCUMENTS

CH 311 292 A 11/1955
CH 705 907 A2 6/2013
(Continued)

OTHER PUBLICATIONS

CH705907 Description, English translation, retrieved from the internet May 30, 2017.*
(Continued)

*Primary Examiner* — Vit W Miska
(74) *Attorney, Agent, or Firm* — Oblon, McClelland, Maier & Neustadt, L.L.P.

(57) ABSTRACT

A shock absorber bearing for an arbor of a timepiece wheel. The arbor includes a pivot-shank, the bearing includes a support including a housing arranged to receive a suspended pivot mechanism, and the pivot mechanism is arranged to absorb, at least in part, any shocks experienced by the timepiece wheel.

16 Claims, 3 Drawing Sheets

(51) Int. Cl.
*G04B 31/06* (2006.01)
*G04B 31/016* (2006.01)

(56) References Cited

U.S. PATENT DOCUMENTS

| | | | | |
|---|---|---|---|---|
| 3,942,848 | A * | 3/1976 | Voumard | G04B 31/02 368/326 |
| 7,344,303 | B2 * | 3/2008 | Conus | G04B 31/04 368/324 |
| 8,702,301 | B2 * | 4/2014 | Hiraoka | G04B 17/06 368/324 |
| 9,625,880 | B2 * | 4/2017 | Girardin | G04B 31/02 |
| 2011/0164478 | A1 | 7/2011 | Conus et al. | |
| 2013/0188462 | A1 | 7/2013 | Helfer et al. | |

FOREIGN PATENT DOCUMENTS

| | | | |
|---|---|---|---|
| EP | 2 605 086 | A1 | 6/2013 |
| EP | 2 142 965 | B2 | 2/2014 |
| WO | 2011/161139 | A1 | 12/2011 |

OTHER PUBLICATIONS

CH705907 Claims, English translation, retrieved from the internet May 30, 2017.*
EP 2605086 Description, English translation, retrieved from the internet May 30, 2017.*
International Search Report dated Jun. 1, 2015 in PCT/EP2014/076783, filed Dec. 5, 2014.

* cited by examiner

BIMATERIAL ANTI-SHOCK SYSTEM FOR TIMEPIECES

CROSS-REFERENCE TO RELATED APPLICATIONS

This is a National Phase Application in the United States of International Patent Application PCT/EP2014/076783 filed on Dec. 5, 2014 which claims priority on European Patent Application No. 13196736.6 filed on Dec. 11, 2013, the entire disclosures of the above patent applications are hereby incorporated by reference.

The present invention concerns a shock absorber bearing for a wheel arbor of a timepiece. The arbor comprises a pivot-shank including a support, said support being provided with a housing for receiving a suspended pivot system into which the pivot-shank is inserted.

The technical field of the invention is the technical field of fine mechanics.

BACKGROUND OF THE INVENTION

The present invention concerns bearings for timepieces and more specifically of the type that absorb shocks. Designers of mechanical watches have long devised numerous devices for absorbing the shock energy resulting from the impact of a wheel arbor against a wall of the hole in the base block through which the arbor passes, which also allow temporary displacement of the pivot-shank before it is returned to its rest position under the action of a spring.

FIG. 1 illustrates a shock absorber device or shock absorber bearing 1 including a support 2. This support has a housing 3 in which is arranged a pivot system 4, the purpose of which is to absorb, at least in part, any shocks experienced by the balance staff 5.

Pivot system 4 includes resilient means 4*a* and a pivot module 4*b*. The resilient means take the form, in this example, of a membrane. These resilient means are in the form of a disc-shaped base including a lower face and an upper face and having a central orifice, the lower face being opposite to the bottom of the support, ie. to hole 6 through which the balance staff, ending in a pivot-shank 5*a*, passes. The pivot module is secured in the centre of this disc. This disc includes, at the periphery thereof, a peripheral rim 4*c* extending in an axial direction, i.e. in a direction tending to move away from the upper face. Preferably, this rim extends such that the surface of the plane horizontal to the disc increases as the height of the rim increases.

Pivot system 4 is placed on the bottom of the support and the rim of the resilient means rests, for example, on a protuberance 2*a* of the support as seen in FIG. 1.

This pivot system is made of plastic material so that it can be fabricated using injection moulding techniques.

However, a drawback of such a shock absorber system is that it is not shock resistant. Indeed, if the pivot does not break, the pivot marks the plastic. The marking of the plastic forming the pivot system is caused by the resilient portion whose Young's modulus increases upon impact. The Young's modulus is also known as the modulus of elasticity (generally expressed in GPa), and it characterizes the resistance of a material to deformation.

Thus, as the Young's modulus increases, so the stress necessary for deformation increases. Consequently, the resistance of the resilient means of the pivot system which is opposed to the pivot increases and so the force between the pivot and the bearing increases. This increase in force for a very short time period may cause local plastic deformation to occur. This deformation can then cause malfunctioning of the shock absorber bearing.

SUMMARY OF THE INVENTION

It is an object of the invention to overcome the drawbacks of the prior art by proposing to provide an anti-shock system for timepieces which has constant damping and friction characteristics.

To this end, the invention concerns a shock absorber bearing for an arbor of a timepiece mobile part, said arbor including a pivot-shank, said bearing comprising a support provided with a housing arranged to receive a suspended pivot means, said pivot means is arranged to absorb, at least in part, any shocks experienced by the timepiece wheel, wherein the pivot means is made of a metal material and includes a recess in which is inserted an insert made of synthetic material which cooperates with the pivot-shank.

In a first advantageous embodiment of the invention, the insert is made of a polymer material.

In a second advantageous embodiment of the invention, the material of the insert is a loaded material.

In a third advantageous embodiment of the invention, the polymer of the insert is chosen from the group including polyoxymethylene, polyamide, polyetheretherketone, and polyphenylene sulphide.

In a fourth advantageous embodiment of the invention, said pivot means is a disc including an annular portion, a central portion and resilient arms connecting the central portion to the annular portion, the central portion including a recess so that an insert, with which the pivot can cooperate, can pivot freely therein.

In another advantageous embodiment of the invention, the pivot means includes three resilient arms angularly offset at an angle of 120°.

In another advantageous embodiment of the invention, the insert includes a hole for insertion of the pivot, this hole consisting of an opening having a first straight or rectangular portion followed by a trapezoidal portion.

The invention advantageously also concerns a method for fabrication of a shock absorber bearing for a timepiece mobile part including an arbor, said arbor including a pivot-shank and a pivot, said bearing including a support provided with a housing arranged to receive a suspended pivot means, wherein said method includes the following steps:

a) Taking the support and the pivot means comprising a recess, then placing the pivot means inside the housing in the support.

b) Taking the arbor and the insert comprising a hole for insertion of said pivot therein.

c) Placing the insert on the arbor so that the arbor pivot is inserted inside the hole in the insert.

c) Mounting the shock absorber bearing by manipulating the arbor so that the insert mounted on the arbor penetrates the recess.

In a variant of the method, said method includes the following steps:

A) Taking the support and the pivot means comprising a recess, then placing the pivot means inside the housing in the support.

B) Taking the arbor and over moulding the pivot with a material to form an insert.

C) Mounting the shock absorber bearing by manipulating the arbor so that the insert on the arbor penetrates the recess.

BRIEF DESCRIPTION OF THE DRAWINGS

The objects, advantages and features of the anti-shock system according to the present invention will appear more clearly in the following detailed description of at least one embodiment of the invention, given solely by way of non-limiting example and illustrated by the annexed drawings, in which.

DETAILED DESCRIPTION

The present invention proceeds from the general inventive idea which consists in providing a more reliable shock absorber system or anti-shock system which provides improved positioning.

Figure 1:
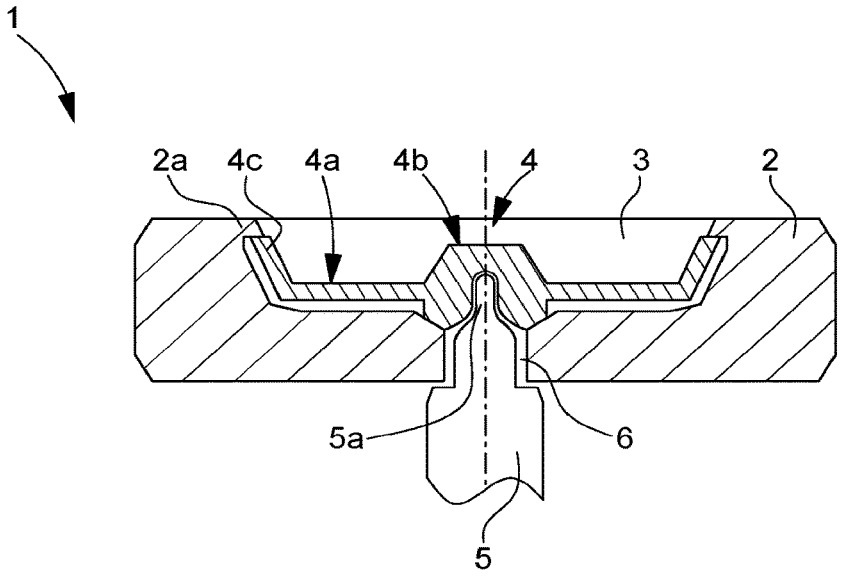
Fig. 1 (Prior Art)
FIG. 1 is a schematic view of a prior art anti-shock system for timepieces.
Figure 2:
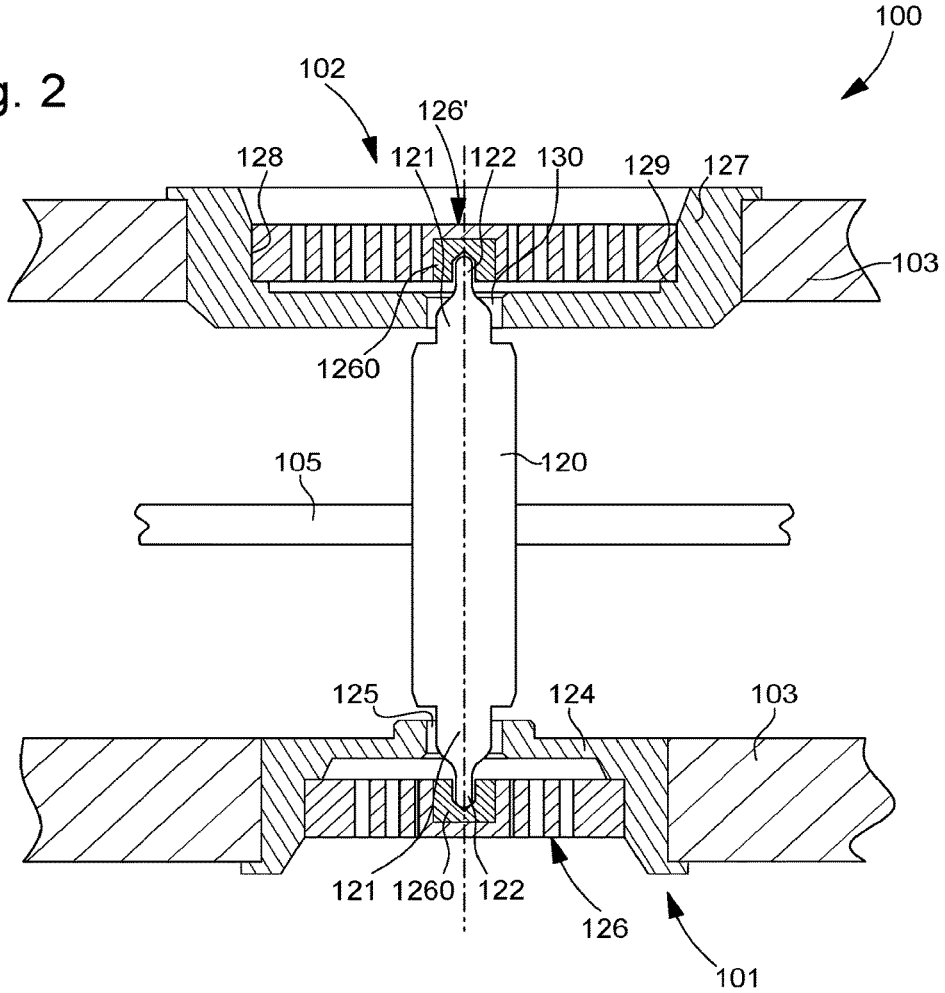
FIGS. 2 and 3 are schematic views of a timepiece anti-shock system according to the invention.

The shock absorber bearing or anti-shock system 100 is shown in FIG. 2, which illustrates a part of a timepiece provided with bearings according to the invention.

The shock absorber bearing 100 shown in FIG. 2 includes a frame comprising a support 103, in which a lower bearing 101 and an upper bearing 102 are mounted. These bearings 101, 102 are mounted in holes made in said support 103. A mobile part 105, which may be a balance wheel, is mounted on an arbor 120 so as to pivot in the bearings. This arbor 120 is provided at both ends with pivot-shanks 121 carrying pivots 122.

Upper bearing 102 includes an annular portion 127 taking the form of a disc with a peripheral inner wall 128. This annular portion also includes a rim 129 located on the surface of the disc and contiguous with the wall. Annular portion 127 is pierced with a central hole 130. Bearing 102 further includes a pivoting means 126' arranged in the recess formed by the peripheral wall 128 and rim 129. Pivot means 126' is placed on the periphery of rim 129 so as to be suspended. This pivot means 126' is attached to annular portion 127, for example by being pressed in, by bonding, snap fit or being retained by a ring. A space therefore exists between pivot means 126' and the bottom of the housing formed by peripheral wall 128 and rim 129. The pivot means are therefore only in contact with support 101 at the point of attachment thereto. Being suspended allows pivot means 126' to be perfectly recentred following displacement caused by a shock.

Lower bearing 101 is of identical design to upper bearing 102, i.e. it includes an annular portion 124 taking the form of a disc with a peripheral wall. This annular portion also includes a rim located on the surface of the disc and adjacent to the wall. Annular portion 124 is pierced with a central hole 125. Bearing 102 further includes a pivot means 126 arranged in the housing formed by the peripheral wall and the rim in a suspended manner. This pivot means 126 is attached to annular portion 124, for example by being pressed in, by bonding, snap fit or being retained by a ring. In this example, the dimensions of lower bearing 101 will be smaller than those of upper bearing 102 in order to demonstrate that the size of the bearing is easy to modulate and can be reduced. Of course, the dimensions of upper bearing 102 and lower bearing 101 may be identical.

However, in a first variant (not shown), lower bearing 101 or upper bearing 102 may be arranged so that pivot means 126, 126' is directly secured in support 103 by being pressed in, or by bonding or welding or soldering. Said bearing 101, 102 may include a part 200 in the form of a ring, which is used to hold pivot means 126, 126' and a part 201 in the form of a disc, which has a peripheral rim and is pierced at the centre with a hole. This pierced disc-shaped part 201 is used to serve as a stop member and its rim is used to provide a suspended system. Pivot means 126, 126' is thus held radially by the walls of the hole made in the support and axially by the annular portion and the pierced disc-shaped part.

Figure 3:
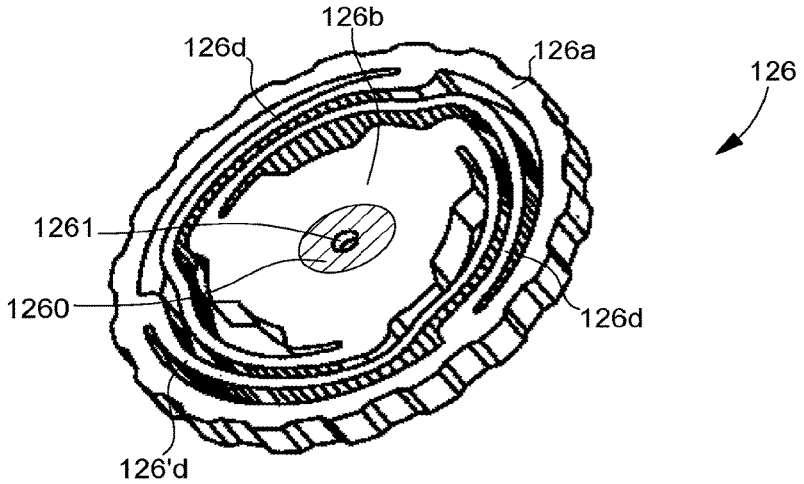

The pivot means 126, 126', shown in FIG. 3, take the form of a disc comprising a solid annular portion **126*a*, a central portion 126*b* and resilient arms 126*d*. Arms 126*d* are wound substantially in a spiral to that they connect central portion 126*b* to annular portion 126*a*. Preferably, pivot means 126, 126' have three arms 126*d*. Pivot means 126' of upper bearing 102 are mounted in annular portion 127 of said upper bearing 102. Pivot means 126 of lower bearing 101 are mounted in annular portion 124 inserted in the hole in support 103**.

Advantageously according to the invention, the central portion of pivot means 126, 126' has a recess **126*e* in which an insert 1260 is inserted. This insert 1260 is used such that it is provided with a hole 1261 into which the pivot-shank of the arbor is inserted. This configuration makes it possible to obtain pivot means 126, 126' in the form of a disc including a solid annular portion 126*a*, a central portion 126*b* and resilient arms 126*d*, which are made of a first material, and insert 1260 which is made of a second material. The wheel is thus pivotally mounted by the engagement of its pivots 122 in blind cylindrical holes 1261 of insert 1260 and of its pivot-shanks 121 in the holes in support 103**.

This configuration permits the use of a specific material for the pivot means 126, 126', i.e. which is suited to the damping function, and a specific material for the insert, i.e. a material suitable for a pivot function with a low friction coefficient.

According to the invention, the first material used for pivot means 126, 126' is a metallic material, while the second material used for insert 1260 is a synthetic material such as plastic. This plastic material may be a polymer chosen from the group including polyoxymethylene, polyamide, polyetheretherketone and polyphenylene sulphide.

The use of a metallic material for the resilient means, i.e. pivot means 126, 126', makes it possible to obtain resilient means whose Young's modulus does not vary with velocity. Consequently, the resistance of the resilient means of the pivot system which is opposed to the pivot does not increase and the force between the pivot and the bearing remains stable.

Further, metals have a higher Young's modulus than plastic material (for example the Young's modulus of phynox (cobalt Co+chromium Cr+nickel Ni+molybdenum Mo) is 203 GPa, that of titanium is 114 GPa, that of plexiglas is 2.38 GPa and that of polyamide is from 3 to 5 GPa). This difference in Young's modulus value means that higher stress has to be applied to metals for them to deform. Thus, with the same stress on the pivot, metal pivot means 126, 126' will move less than plastic pivot means 126, 126'. Metals also permit reliable methods of assembly that are incompatible with polymers, particularly pressing in (no significant creep), welding or soldering (temperature).

Another advantage of this choice of materials is that it enables a more advantageous material to be used for the pivot function. Indeed, the friction of one metal part on another metal part results in heating and rapid wear of the pivot, and lubrication is thus necessary to reduce heating.

With a plastic insert 1260, there is less friction with a metal pivot. Further, there are self-lubricating plastics. These plastics are known to have particularly advantageous friction related characteristics so that additional lubrication with oil becomes unnecessary.

In a variant, the plastic material of insert 1260 is a loaded polymer. The general term a "loading agent" means any inert, mineral or plant substance which, when added to a polymer base, can significantly modify its mechanical, electrical or thermal properties or its appearance.

In the event of an axial shock, wheel 105 is subjected to a force which is proportional to the acceleration experienced. This force is transmitted to the bearings via pivots 122. The effect of this force is to deform resilient arms 126*d* of pivot means 126, 126' until the arbor 120 of the wheel rests, via pivot-shanks 121, against the wall of holes 1261. In such case, the wheel is then stopped by arbor 120 which abuts against support 127, 124 acting as a stop member. As the dimensions of arbor 120 are much greater than those of pivots 122, the energy produced upon impact against the stop member is therefore transmitted to arbor 120 avoiding damage to pivots 122.

Preferably, resilient arms 126*d* are sized so that pivot-shanks 121 enter into contact with the annular portions as soon as an acceleration of round 500 g is reached.

Preferably, pivot means 126, 126' are formed by three bent arms 126*d*, whose points of attachment, respectively to annular portion 126*a* and to central portion 126*b*, are angularly offset by 120 degrees. It is clear that the resilient function could be ensured with a different number of arms, or with different shapes.

It is also possible for insert 1260 to include a conical hole 1261 so that the end of the pivot-shank can be inserted therein, thus reducing the difference in amplitude between the different positions of the watch to a minimum. This conical hole 1261, known from EP Patent 2142965, consists of an opening having a first straight or rectangular portion, i.e. having a straight or rectangular profile, followed by a trapezoidal portion, i.e. having a trapezoidal profile. The rounded tip of pivot 122 is sized so that its rounded surface can abut against the inclined edge of the portion of trapezoidal profile.

Figure 4:
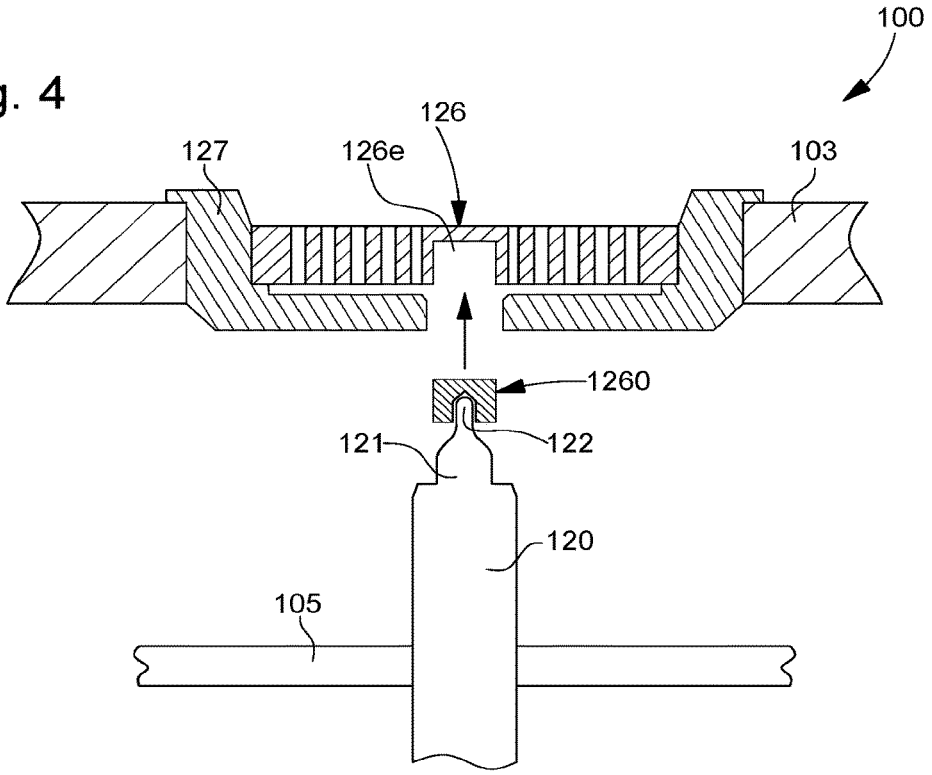
FIGS. 4 and 5 are schematic views of a timepiece anti-shock system according to a variant of the invention.
Figure 5:
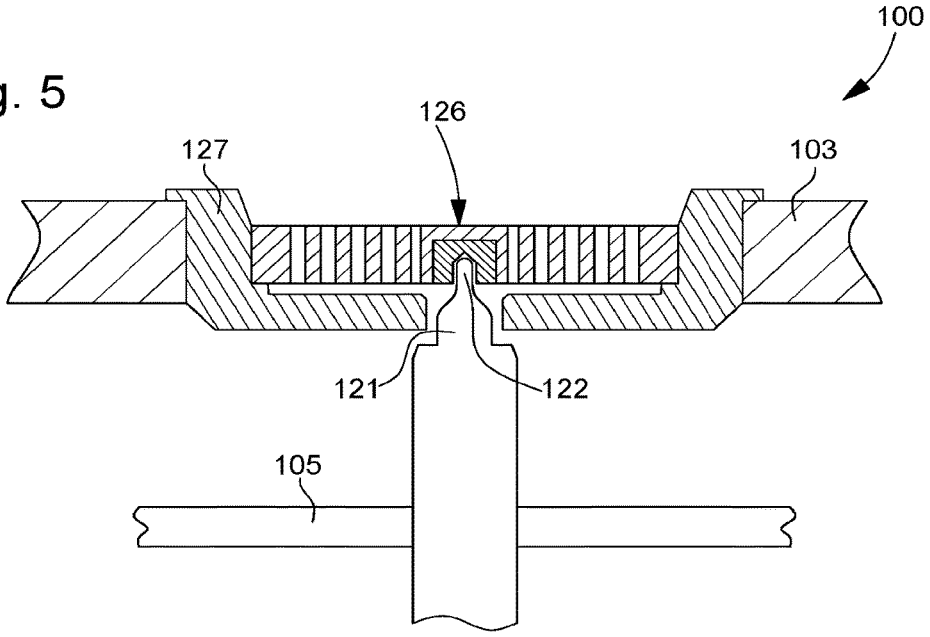

In a variant of the invention seen in FIGS. 4 and 5, the invention also concerns a method for mounting such a shock absorber bearing 100. This method consists in making pivot means 126, 126' and insert 1260 separately.

Then, insert 1260 is placed on arbor 120 at the two pivot-shank ends 121 carrying pivots 122. This arrangement of insert 1260 provides protection for pivots 122, so that the latter are not subjected to impact forces.

Finally, the system is assembled. Thus, pivot means 126, 126' are mounted in supports 103. Arbor 120 is then mounted between lower bearing 101 and upper bearing 102. To achieve this, arbor 120 is manipulated so that each insert 1260 mounted on pivots 122 is forcibly inserted in the recess 126*e* of the pivot means 126, 126' intended to receive them.

In short, the method consists in:

a) Taking support 102, 102 and pivot means 126, 126' comprising a recess 126*e* and then placing pivot means 126, 126' inside the housing in support 102, 103.

b) Taking arbor 120 and insert 1260 comprising a hole 1261 for insertion of said pivot 122 therein.

c) Placing insert 1260 on arbor 120 so that arbor pivot 122 is inserted inside insert 1260.

d) Mounting the shock absorber bearing by manipulating arbor 120 so that insert 1260 mounted on arbor 120 penetrates recess 126*e*.

In a variant, inserts 1260 are made directly on arbor 120. To achieve this, pivots 122 of arbor 120 are placed in the moulds used for fabricating inserts 1260. The synthetic material used for inserts 1260 is then injected into the moulds to form inserts 1260. This variant is advantageous since it ensures perfect cooperation between inserts 1260 and pivots 122 of arbor 120. The method therefore consists in:

A) Taking support 102, 103 and pivot means 126, 126' comprising a recess 126*e* and then placing pivot means 126, 126' inside the housing in support 102, 103.

B) Taking arbor 120 and over moulding pivot 122 with a material so as to form an insert 1260.

C) Mounting the shock absorber bearing by manipulating arbor 120 so that insert 1260 on arbor 120 penetrates recess 126*e*.

It will be clear that various alterations and/or improvements and/or combinations evident to those skilled in the art may be made to the various embodiments of the invention set out above without departing from the scope of the invention defined by the annexed claims.

The invention claimed is:

1. A shock absorber bearing for an arbor of a timepiece mobile part, the arbor including a pivot-shank and a pivot, the bearing comprising:

a support including a housing arranged to receive a suspended pivot structure, the pivot structure is arranged to absorb, at least in part, any shocks experienced by a timepiece wheel, wherein the pivot structure is made of a metallic material and includes a recess in which is inserted an insert made of synthetic material and with which the arbor pivot cooperates, the insert is fitted forcibly in the recess, the housing includes an aperture through which the arbor pivot is insertable in an axial direction of the arbor, and a maximum width of the insert in a perpendicular direction that is perpendicular to the axial direction is less than a minimum width of the aperture in the perpendicular direction.

2. The shock absorber bearing according to claim 1, wherein the insert is made of a polymer material.

3. The shock absorber bearing according to claim 2, wherein the insert material is a loaded material.

4. The shock absorber bearing according to claim 2, wherein the polymer of the insert is chosen from the group of polyoxymethylene, polyamide, polyetheretherketone, and polyphenylene sulphide.

5. The shock absorber bearing according to claim 3, wherein the polymer of the insert is chosen from the group of polyoxymethylene, polyamide, polyetheretherketone, and polyphenylene sulphide.

6. The shock absorber bearing according to claim 1, wherein the pivot structure is a disc including an annular portion, a central portion, and resilient arms connecting the central portion to the annular portion, the central portion including a recess to insert an insert, with which the pivot can cooperate for free rotation.

7. The shock absorber bearing according to claim 6, wherein the pivot structure includes three resilient arms angularly offset at an angle of 120°.

8. The shock absorber bearing according to claim 6, wherein the insert includes a hole to insert the pivot structure, the hole including an opening having a first straight or rectangular portion followed by a trapezoidal portion.

9. The shock absorber bearing according to claim 1, wherein the insert includes a curved outer periphery.

10. The shock absorber bearing according to claim 1, wherein the insert includes a molded hole that is molded over the pivot so that the hole is perfectly fitted to the pivot.

11. The shock absorber bearing according to claim 1, wherein the maximum width of the insert in the perpendicular direction that is perpendicular to the axial direction is less than the minimum width of the aperture in the perpendicular direction so that the arbor pivot with the insert disposed on the arbor pivot are insertable together through the aperture to insert the insert in the recess of the pivot structure.

12. A method for fabrication of a shock absorber bearing for an arbor of a timepiece mobile part, the arbor including a pivot-shank and a pivot, the bearing including a support provided with a housing arranged to receive a suspended pivot structure, the method comprising:

taking the support and the pivot structure including a recess and then placing the pivot structure inside the housing in the support;

taking the arbor and an insert including a hole to insert the pivot therein;

placing the insert on the arbor so that the arbor pivot is inserted inside the hole in the insert;

inserting the arbor pivot with the insert disposed on the arbor pivot together through an aperture of the housing; and mounting the shock absorber bearing by manipulating the arbor so that the insert mounted on the arbor penetrates the recess.

13. The method for fabrication of a shock absorber bearing according to claim 12, wherein the pivot structure is made of a metallic material and the insert is made of synthetic material.

14. A method for fabrication of a shock absorber bearing for an arbor of a timepiece mobile part, the arbor including a pivot-shank and a pivot, the bearing including a support provided with a housing arranged to receive a suspended pivot structure, the method comprising:

taking the support and the pivot structure including a recess and then placing the pivot structure inside the housing in the support;

taking the arbor and over molding the pivot with a material to form an insert; and mounting the shock absorber bearing by manipulating the arbor so that the insert on the arbor penetrates the recess.

15. The method for fabrication of a shock absorber bearing according to claim 14, wherein the pivot structure is made of a metallic material and the insert is made of synthetic material.

16. The method for fabrication of a shock absorber bearing according to claim 12, wherein a maximum width of the insert in a perpendicular direction that is perpendicular to an axial direction of the arbor is less than a minimum width of an aperture of the housing in the perpendicular direction.

* * * * *